US009508207B2

(12) United States Patent
Kalb et al.

(10) Patent No.: US 9,508,207 B2
(45) Date of Patent: Nov. 29, 2016

(54) METHOD AND APPARATUS FOR NETWORK CONTROLLED ACCESS TO PHYSICAL SPACES

(71) Applicant: StoryCloud, Inc., San Diego, CA (US)

(72) Inventors: Kenneth J. Kalb, Solana Beach, CA (US); Michael W. Tracy, Solana Beach, CA (US); Barry Shapira, Solana Beach, CA (US)

(73) Assignee: StoryCloud Incorporated, San Diego, CA (US)

( * ) Notice: Subject to any disclaimer, the term of this patent is extended or adjusted under 35 U.S.C. 154(b) by 72 days.

(21) Appl. No.: 14/485,012

(22) Filed: Sep. 12, 2014

(65) Prior Publication Data

US 2016/0078699 A1 Mar. 17, 2016

(51) Int. Cl.
*G07C 9/00* (2006.01)

(52) U.S. Cl.
CPC ... *G07C 9/00571* (2013.01); *G07C 2009/0042* (2013.01); *G07C 2009/00865* (2013.01); *G07C 2209/08* (2013.01); *G07C 2209/63* (2013.01)

(58) Field of Classification Search
CPC ..... G07C 9/00571; G07C 2009/0042; G07C 2009/00865; G07C 2209/08; G07C 2209/63
See application file for complete search history.

(56) References Cited

U.S. PATENT DOCUMENTS

| | | | | |
|---|---|---|---|---|
| 8,041,610 | B1 | 10/2011 | Cirelli | |
| 2010/0133339 | A1 | 6/2010 | Gibson | |
| 2010/0176917 | A1 | 7/2010 | Bacarella | |
| 2011/0178827 | A1 | 7/2011 | Orenstein | |
| 2011/0202466 | A1* | 8/2011 | Carter | G06Q 20/3674 705/67 |
| 2012/0185394 | A1 | 7/2012 | Gelfand | |
| 2012/0270496 | A1* | 10/2012 | Kuenzi | G07C 9/00309 455/41.1 |
| 2014/0084165 | A1* | 3/2014 | Fadell | G08B 17/00 250/340 |
| 2015/0154513 | A1 | 6/2015 | Kennedy | |
| 2015/0221152 | A1* | 8/2015 | Andersen | G07C 9/00309 340/5.22 |
| 2015/0287256 | A1* | 10/2015 | Davis | G05B 19/02 340/5.25 |

FOREIGN PATENT DOCUMENTS

| | | |
|---|---|---|
| WO | 2014005004 A1 | 1/2014 |
| WO | 2014029774 A1 | 2/2014 |
| WO | 2014047501 A1 | 3/2014 |

OTHER PUBLICATIONS

International Search Report and Written Opinion dated Dec. 7, 2015, regarding PCT/US2015/049817.

* cited by examiner

*Primary Examiner* — Leon Flores
(74) *Attorney, Agent, or Firm* — Arent Fox LLP

(57) ABSTRACT

The system provides a method and apparatus for providing controlled access to premises. The system in one embodiment uses a reader/scanner associated with a controlled entrance that can receive credentials manually or via scanning or some other form of electronic communication. In one embodiment, the system uses NFC (Near Field Communication) from a mobile device to determine if access should be granted. The system contemplates a number of different tiers of users whose right of access to a location depends on the tier in which the user resides. For one time visitors, the system contemplates transmitting an access credential that can be used by a specific user for a limited time period. In some cases, the access credential is tied to a particular device.

16 Claims, 6 Drawing Sheets

METHOD AND APPARATUS FOR NETWORK CONTROLLED ACCESS TO PHYSICAL SPACES

BACKGROUND OF THE SYSTEM

There are many physical locations where it is desired to limit or control access. Typically this is accomplished by providing keys and/or pass codes to authorized visitors. For example, a homeowner and related family members may all have keys to the doors of their home. Sometimes a non-resident might have a key for emergency purposes. In a commercial space, the tenants or occupants may have some combination of keys, pass cards, access codes, and the like to permit entry onto the premises. Such entry may be at all times or may be restricted to certain time periods.

Whether residential or commercial, there are many instances where visitors, vendors, support personnel, repair people, delivery people, emergency personnel, first responders, medical professionals, and the like will need access to the premises. In the prior art, access is controlled a number of ways.

At the home, access may require that a family member be home to receive a visitor or vendor, so that desired services can be provided. This can create many disadvantages, particularly where the visitor cannot commit to a specific time of day. (e.g. cable companies may schedule a delivery time from 8 in the morning till 4 in the afternoon, with no commitment as to when within that time period they will appear). There may be trusted visitors who may be permitted in the home even without the presence of family members, but providing access either requires a family member to be present, or to somehow hide a key outside the home for retrieval by the visitor. In other instances, a visitor may be arriving late at night, and the family members may desire to provide access without waking up. There is no current process that provides a useful solution to these dilemmas.

In a commercial space, there may be a security station that allows visitors to be signed in, checked against a list of authorized visitors, and provided escorted access to the premises. Such a system requires full time security personnel to be available during the times of expected access, an expensive proposition. In addition, a tenant may forget to inform the security desk that the visitor is authorized, requiring last minute communication to resolve such problems.

SUMMARY

The system provides a method and apparatus for providing controlled access to premises. The system in one embodiment uses a reader/scanner associated with a controlled entrance that can receive credentials manually or via scanning or some other form of electronic communication. In one embodiment, the system uses NFC (Near Field Communication) from a mobile device to determine if access should be granted. The system contemplates a number of different tiers of users whose right of access to a location depends on the tier in which the user resides. For one time visitors, the system contemplates transmitting an access credential that can be used by a specific user for a limited time period. In some cases, the access credential is tied to a particular device, to provide a form of authentication of the user, to prevent a temporary visitor from sharing the access credential with another. In/Out privileges can be managed so that the credential may be disabled after the first use. In another embodiment, there may be an ability to provide a second access credential, or an additional use of the first access credential, to allow a visitor to exit and return. In addition to the access credential, the system may employ a challenge and response prior to allowing permission to use any access credential, to provide additional confirmation of the identity of the visitor.

The system can also be tied into a calendar program that is linked to a building security system. When a user creates or accepts an appointment with a visitor, the system can generate an access credential for the visitor, transmit the access credential to the visitor, update expected visitor logs, and determine any special level of privileges that might be associated with the visitor.

In another embodiment, the access credentials are available as dynamic links over a network and not as downloaded data. This provides an additional level of security because the visitor also needs permissions to access the dynamic link system.

In another embodiment, the system allows the definition of groups of visitors who may desire access at or about the same time to a premise. The system can generate the required access credentials and permissions for the entire group at one time or as acknowledgements and appointments are made by the group.

In another embodiment, the system provides ancillary access to certain parts of a location that are appropriate for the visitor, e.g. locked restrooms, conference rooms, elevator access, and the like, to facilitate the visit suing the system.

DETAILED DESCRIPTION OF THE SYSTEM

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

The word "exemplary" is used herein to mean serving as an example, instance, or illustration. Any embodiment described herein as "exemplary" is not necessarily to be construed as preferred or advantageous over other embodiments. Likewise, the term "aspect" of an apparatus, method or article of manufacture does not require that all embodiments of the invention include the described components, structure, features, functionality, processes, advantages, benefits, or modes of operation.

The system provides a method and apparatus for providing controlled access to premises. In one embodiment, the system utilizes a number of components for operation, including an access control interface, a data controlled access portal, a communications infrastructure, a key emulator, and an authentication system. In one embodiment, the system uses dynamic links to provide temporary and controlled keys to a visitor. Because the visitor never has physical control of the virtual key, the key can be revoked or modified at any time, and even re-used if desired, simply be severing the dynamic link with the visitor.

Figure 1:
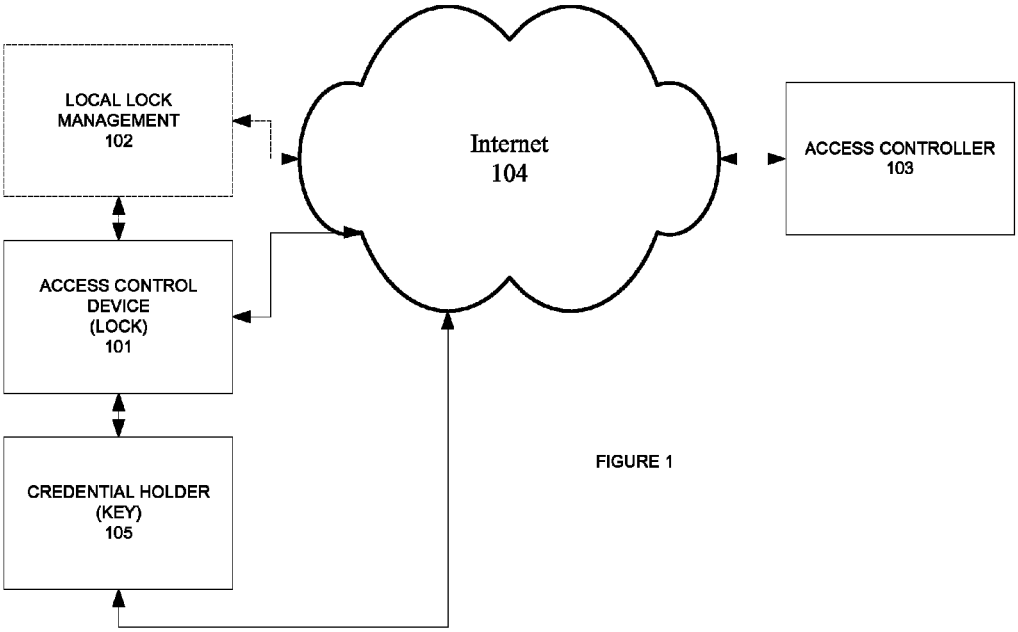
FIG. 1 is an example of an embodiment of a controlled access system.

FIG. 1 illustrates an exemplary embodiment of the system. The system comprises an Access Control Device 101, optional Local Lock Management module 102, Access Controller 103, Network 104, and Credential Holder (Key) 105. The Access Control Device 101 is used to deny and permit access to a visitor (i.e. Credential Holder 105). The Access Control Device 101 may be a lock at a location in one embodiment of the system. In other embodiments, it may be a set of instructions to a security checkpoint that provides a "sign-in" of an expected and permitted visitor to the location.

In one embodiment, shown as optional in FIG. 1, the Access Control Device 101 is coupled to a Local Lock Management module 102 (shown in dotted line). The Lock Management Module 102 is used to control the operation of Lock 101, allowing it to be opened when presented with an appropriate Credential Holder (Key) 105.

In operation, the Access Controller 103 is the entity that can provide permission for a visitor to access a location. The Access Controller 103 communicates with the Access Control Device 101 via the network 104. The Access Controller 103 determines if a visitor will have access to a location and then can send a credential to the Credential Holder 105 via network 104 and update the instructions of the Access Control Device 101 via network 104. The credential defines a date and time during which the credential will be active (i.e. able to open the Lock 101). The credential may be tied to a specific device, such as a mobile device (i.e. cell phone, table computer, touchpad device, or the like). In one embodiment, the system will use geo-location capabilities of the device to determine if the device is in fact in proximity to the access control device 101 before permitting the access to the location.

In one embodiment, the Access Controller 103 communicates permissions to Local Lock Management 102. Local Lock Management 102 then interacts with Access Control Device 101 to program it to respond appropriately to a credential from a Credential Holder 105.

Access Control Device

Figure 2:
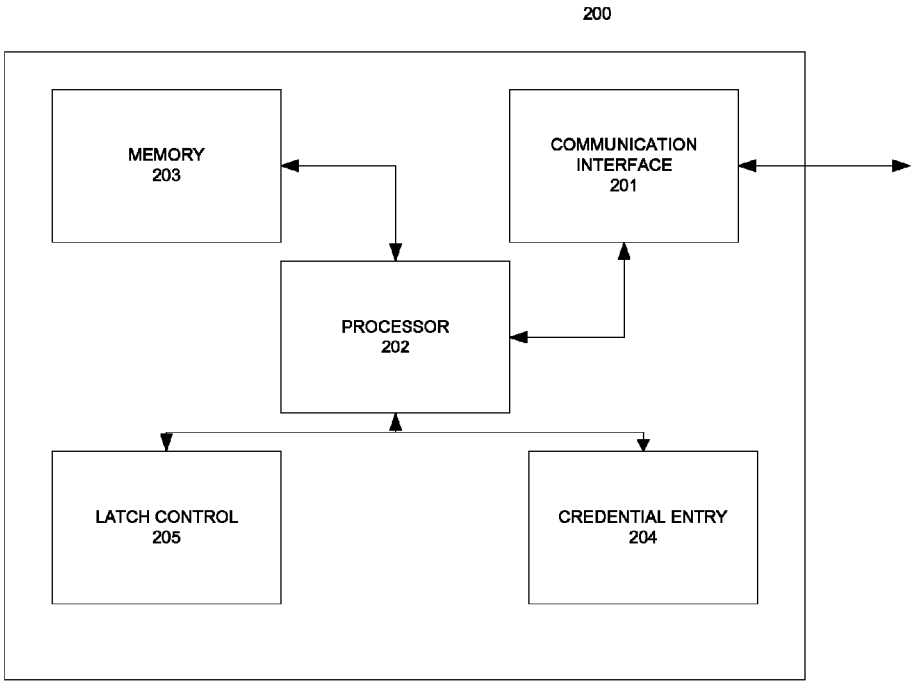
FIG. 2 illustrates an embodiment of an access control device.

The Access Control Device 101 is the means by which access to a location is controlled. This may be in the form of a lock on a door or gate, or it may be a security desk that is populated by one or more security personnel. In the embodiment where the system is implemented as a lock, a lock such as illustrated in FIG. 2 may be utilized. The Access Control Device 200 includes Communication Interface 201, Processor 202, Memory 203, Credential Entry 204, and Latch Control 205.

The Communication Interface 201 is used to facilitate communication between the Access Control Device 200 and other entities, via a network. The Interface can control both wired and wireless communication and can enable communication with the Access Controller 103, optional Local Lock Management 102, or other entities. The Device 200 includes a Processor 202 for implementing programs and other operations of the Access Control Device 200, including controlling Memory 203, Credential Entry 204, Latch Control 205, and Communication Interface 201.

Memory 203 is used to store programs for the operation of the Device 200, as well as data related to Credentials that are provided by the Access Controller 103 or Local Lock Management 102. Latch Control is used to engage or disengage the locking mechanism that prevents access to the location in response to a valid Credential.

Credential Entry 204 is used to receive Credential information from a Credential Holder 105. The data may be provided via scanning of a display, a keypad for entering a code, a Near Field Communication (NFC) link, Bluetooth wireless, Infrared, RFID, bar code, 2D bar code, QR code, and the like.

The system allows a person to allow visitors into a location or onto a property using a "temporary pass" or one time key. This is implemented through a credential that is provided to the expected visitor. The system implements a two-phase commit process. The two phase commit could be through separate communication paths or through the same communication path as desired.

Creating a Credential

Figure 3:
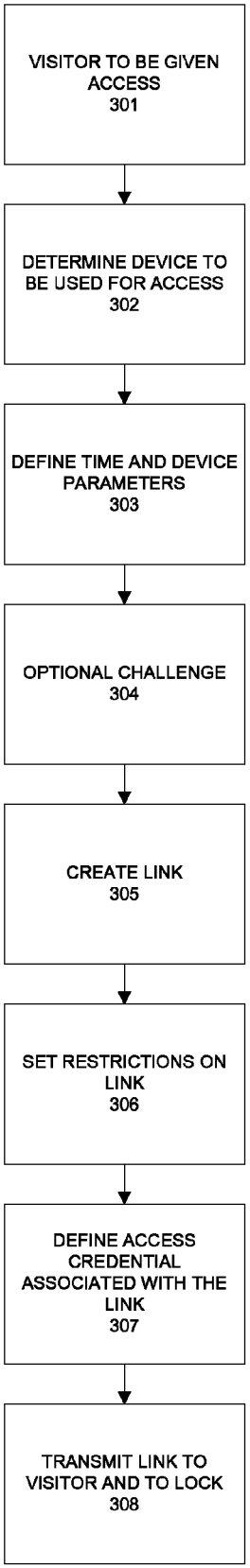
FIG. 3 is a flow diagram illustrating the operation of an embodiment of the system in creating a credential for a visitor.

FIG. 3 is a flow diagram illustrating the operation of an embodiment of the system in creating a credential for a visitor. For purposes of this example, the person or entity that has the right to grant premises access to a visitor is referred to as the "owner". This is not meant to imply property ownership, but rather the authorization to grant access to visitors. An owner may be one of a plurality of owners, each with varying levels of authority to grant permission of entry to visitors.

At step 301, an owner determines that a visitor is to be granted access to the premises. This may be based on a request by a visitor for access to the premises, via a regularly scheduled visitor, or via the owner requesting a visitor. At step 302 the system determines the device to be used by the visitor for access. This may be a smart-phone, a tablet computer, a pad computer, or any other uniquely identifiable mobile device. The device may be associated with a phone number and/or IP address so that it can be identified in a trusted manner. In one embodiment, the system requires that the future access be associated with a particular device in the possession of the visitor. This can reduce the ability to share access and to limit the possibility of fraudulent or unauthorized entry onto the premises.

At step 303 the system sets parameters associated with the entry of the visitor. These parameters include a time range of entry (e.g. the visitor may be given a time window in which access will be permitted. This may be done for a number of reasons. For example, the owner may not want to provide access to more than one visitor at a time, the owner may restrict access to a certain number of visitors in any one time period, or the user may desire that the visitor arrive for some time related purpose, such as a meeting. Other parameters associated with entry may include the device identification associated with the user, in/out permissions, an exit time, and the like. Another parameter may be the GPS coordinates of the device when attempting to access the lock. The system will require that the device be within some defined distance near the lock before the link will be allowed to be accessed by the visitor. In another parameter, the system may require that the access be via a wifi network associated with the lock. The wifi network itself may be password protected with the password unique to the visitor and also time controlled.

The access by the visitor may be asymmetrical, where ingress is controlled but access is open ended, or the access may be symmetrical, where both ingress and egress are controlled, logged, and require a valid access link to accomplish. This information will also be associated with the dynamic link.

At step 304 the system may establish an optional challenge to be presented to the visitor when access is attempted. This can be a passcode, password, or some other challenge and response that provides an extra layer of security to the access process. The challenges may be randomly generated or may be agreed to by the owner and visitor in advance. In some cases, a visitor may have an existing relationship and the challenge may require a physical totem of some kind, such as an encoded passcard. In other cases, the system may require the visitor to scan a fingerprint, iris, or other biodata and forward it to the system for later use in the challenge. Other challenges may include facial recognition, security question(s) passed on publicly available data, security questions based on previously provided personal data, or the like.

At step 305 the system creates a dynamic link to be used for access. The dynamic link will provide a key to the authorized device that will facilitate access to the premises. Restrictions are defined for the link at step 306. These restrictions include the valid time range of the link, whether a challenge is associated with the link, the authorized device to be used for access, and other relevant restrictions on the link. The link will only be valid during the defined time period.

At step 307 the system defines the access credential that will provide entry to the premises. This access credential may be a series of numbers and/or characters, it may be a credential that will provided to the lock via NFC, it may be a QR code, bar code, readable image, fingerprint display, 2D bar code, or other indicia that can be displayed and scanned from a mobile device.

At step 308 the system transmits the access information to the lock and sends an address to the link to the visitor. The address will not be valid until the defined access time and other parameters have been met.

Figure 4:
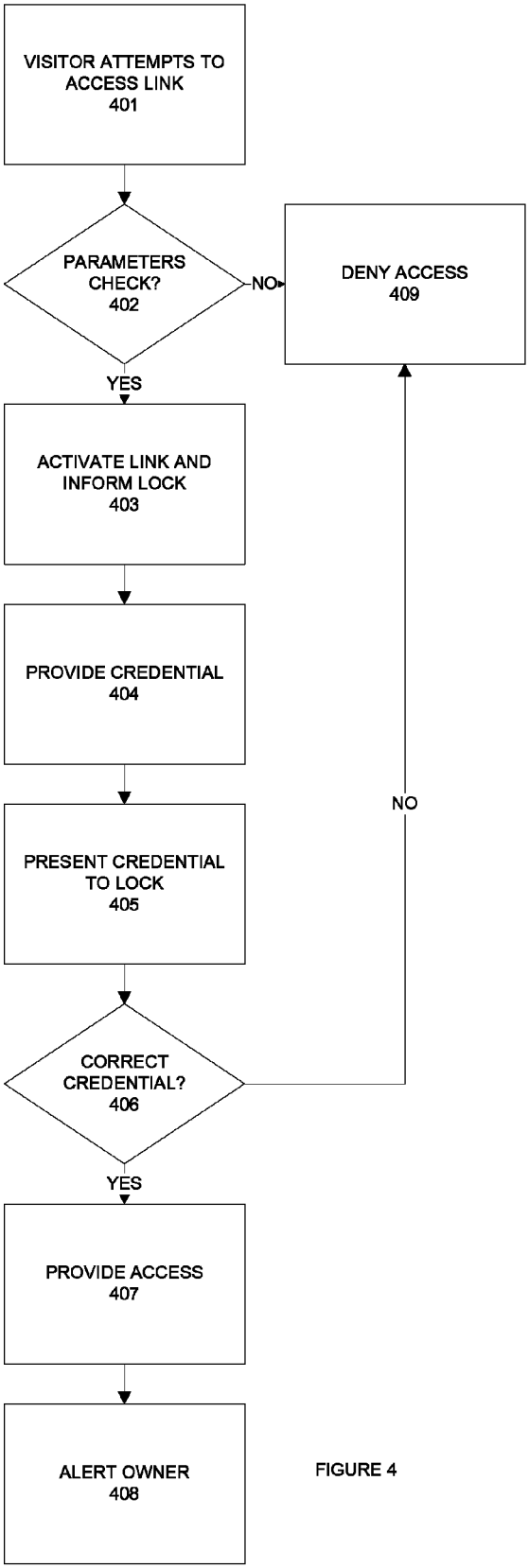
FIG. 4 is a flow diagram illustrating the operation of the system in providing access in one embodiment.

FIG. 4 is a flow diagram illustrating the operation of the system in providing access in one embodiment. At step 401 the visitor attempts to access the link. At decision block 402 the system determines if the parameters associated with the link have been met. If not, the system denies access at step 409.

If the parameters have been met, the system proceeds to step 403 and activates the link. At this point, the lock is also notified that a bonafide user has been authorized to access the link, so the lock is then in a ready state to accept the appropriate credential. When the link has been established, the credential is provided at step 404. Because the system uses a dynamic link in one embodiment, the access credential doesn't reside on the visitor device but is made available only via the link. As noted above, the access credential may be an image, such as a QR code, bar code, biodata image, and the like.

At step 405 the visitor presents the access credential to the lock. This may be via presenting the display of the mobile device to a scanner or image reader, by activating an NFC exchange, by entering a code displayed on the mobile device on a keypad, or via some other suitable entry means. If the lock is connected wirelessly (ie. wifi, Bluetooth, radio, NFC, etc) the visitor's mobile device may be used to wirelessly supply access credentials without the need of visitor input on a physical apparatus. At decision block 406 it is determined if the access credential is the expected and correct credential. If not, the system denies access at step 409. If the access credential is correct, the system provides access at step 407. After step 407 or step 409, the system at step 408 sends an alert to the owner that with an update as to whether access has been granted or denied.

Figure 5:
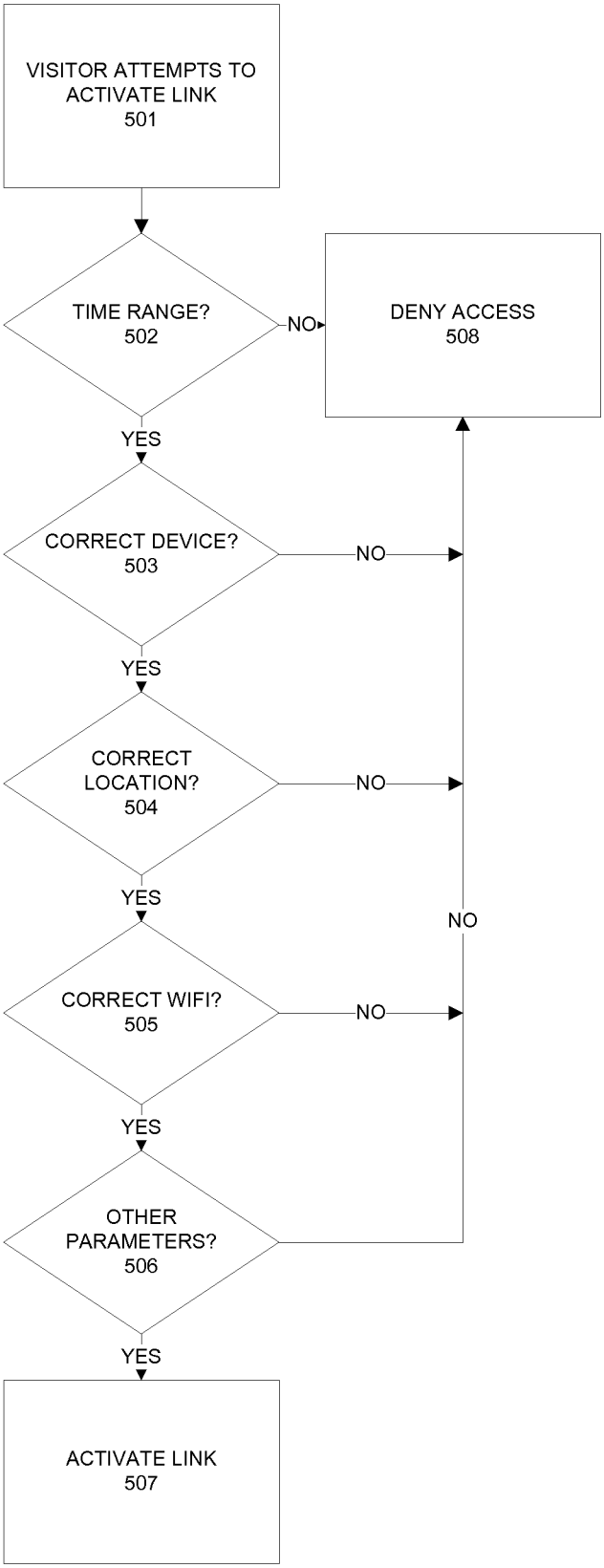
FIG. 5 is a flow diagram illustrating the operation of the system in determining if parameters have been met in one embodiment of the system.

FIG. 5 is a flow diagram illustrating the operation of the system in determining if parameters have been met in one embodiment of the system. At step 501 the visitor attempts to activate the dynamic link. At decision block 502 the system checks to see if the attempt to activate is made during the allowed time range. If not, the system denies access at step 508.

If within the time range, the system checks to see if the request for activation is coming from the correct device at step 503. This is accomplished by checking the IP address of the mobile device in one embodiment. In another embodiment, the system may check the phone number, serial number, device ID, UDID, IFA, IDFA, MAC address, IMEI, MEID, ESN, or any other suitable and trustworthy manner of device identification. If the device is correct, the system proceeds to step 504.

At step 504 the system uses device GPS indicators to determine the location of the mobile device. The location is compared to an allowed range of the device from the lock being accessed. If the mobile device of the visitor is within the prescribed range, the system proceeds to step 505. If not, access is denied at step 508.

At decision block 505, the system determines if the mobile device is communicating on the preferred wifi network. The system will provide to the visitor the correct wifi network to use along with access information. If the visitor is not using the correct wireless network the system denies access.

At decision block 506 the system determines if there are other parameters and if they have been met. As noted previously, these parameters could include challenges, physical tokens such as pass cards, bio-data, and any other parameters that can provide additional security and reliability to the owner.

If the visitor provides the correct other parameters at decision block 506, the system activates the link at step 507. Otherwise access is denied at step 508.

By utilizing dynamic links to provide the credentials and access credentials to use as keys in the lock, the system attains a number of advantages. One advantage is the automatic disabling of credentials when the time period associated with the lock has expired. The system also updates the access control device 101 to disable the ability of a particular credential to be used after the time period has expired. Thus, even if a visitor somehow captures the display generated by the link, the credential no longer works. In addition, the access control device is programmed to permit a credential to be used only once, with subsequent access attempts denied. Thus there is no need to create and manage a large number of physical keys, key cards, and the like, providing additional security.

Another advantage is the inability of incorrect mobile devices to access the dynamic links. This reduces the chance of an unauthorized visitor sharing the credential or somehow subverting the system by attempting to access a legitimate dynamic link.

Private Social Network

In one embodiment, the system may be implemented in a private social network. The private social network is comprised of a plurality of members. Each member can be classified, individually or in groups, by an administrator or an owner of a lock that can be controlled by the system. The access control device 101 can be programmed to admit any member of the private social network who has a classification or permission level that permits access to the premises. This allows the owner to easily and rapidly provide or deny admittance to a premises by reclassifying a network member appropriately. The operation of the lock requires that the visitor be an authorized member of the private social network as well as in the appropriate classification. Otherwise access is denied.

Figure 7:
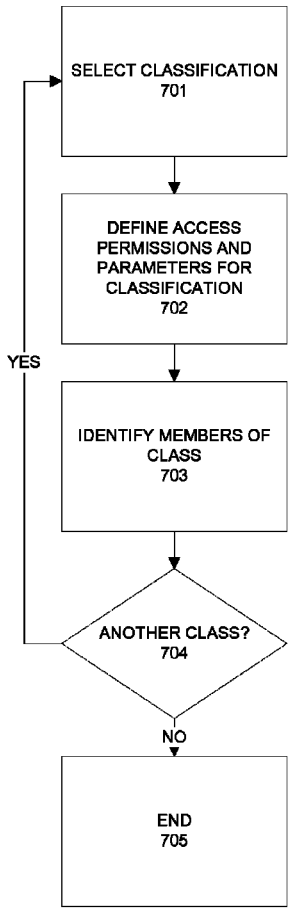
FIG. 7 is a flow diagram illustrating the operation of defining access classifications in a private social network in one embodiment of the system.

FIG. 7 is a flow diagram illustrating the operation of the system in connection with a private social network. At step 701 the owner selects a classification. This may be one of a plurality of available classifications or it may be a new class that the owner is creating. At step 702 the owner defines the access permissions and parameters for the classification. This can be time and device dependent, or it could have any of a plurality of parameters. In one embodiment, the system can take advantage of the ability of the private social network to track behaviour and other parameters, and use those metrics to define access privileges.

At step 703, the members of the private social network that are to be in the class are determined and added to the class. At decision block 704 the system determines if there is another class to be defined or modified. If so, the system returns to step 701. If not, the process ends at step 705.

Figure 8:
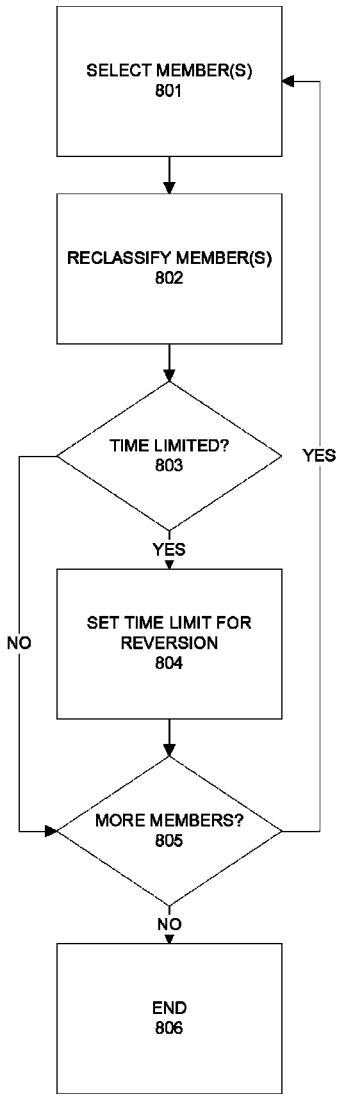
FIG. 8 is a flow diagram illustrating the reclassification of a member of a private social network in an embodiment of the system.

FIG. 8 is a flow diagram illustrating the reclassification of a member of a private social network in an embodiment of the system. At step 801 the owner selects a member or a group of members whose access permissions are to be changed. This may be accomplished by manually selecting one or more members to be modified, and/or by selecting a particular class of members of the private social network.

At step 802 the owner reclassifies the selected member(s). This may be accomplished by assigning them to a different class, or by manually defining the parameters to be used in providing access to the premises. At decision block 803 it is determined if the reclassification of the member(s) is to be permanent or time limited. If the changes are to be time limited, the system proceeds to step 804 where the owner sets the time limit for the reclassification, after which the member(s) will revert back to their previous class.

If there is no time limit at 803, or after the time limit is set, the system proceeds to decision block 805 to determine if there are more members to classify. If so, the system returns to step 801. If not, the process ends at step 806.

An advantage of using the private social network to control access is the ease by which a changing membership can be accommodated. For example, the private social network could be associated with a place of work. When a new employee joins, there is no need to create pass cards and to update the system to accept the new user. The new employee can just be give access to the private social network at the appropriate classification and can use their own smart-phone as their pass card. Similarly, when an employee leaves, the owner simply removes them as an authorized member of the private social network, eliminating future access by that person. Each floor, elevator, and room can have different permissions for each class of employee, so that it is easy to control access accordingly.

The private social network utilizes dynamic links to provide data and content to the user. Because the access credential never resides on the mobile device of the member, there is no risk of access by the user once the dynamic link has been disabled. All of the safeguards and restrictions described above may also be employed in the private social network embodiment. The private social network embodiment may also be used in non-employment situations, such as fraternities, parties, family members, and the like. The credentials can be made available temporarily, such as to a babysitter, or other vendor, by providing temporary membership in the private social network at the appropriate class level.

The ability to modify access is not limited to time, device, or challenges. In particular, in the setting of the private social network, the access parameters by be more robust and conditional. For example, access may be conditioned to accomplishments that can be tracked in the private social network. Access may be limited to members who have visited to particular locations prior to seeking access. The private social network can track user access to the other locations using previous grants of access or by using geo-location data associated with the mobile device of a member. Access may also be tied to other networked items. For example, the private social network may be used to access data from an exercise tracking device, such as Fitbit™.

Figure 9:
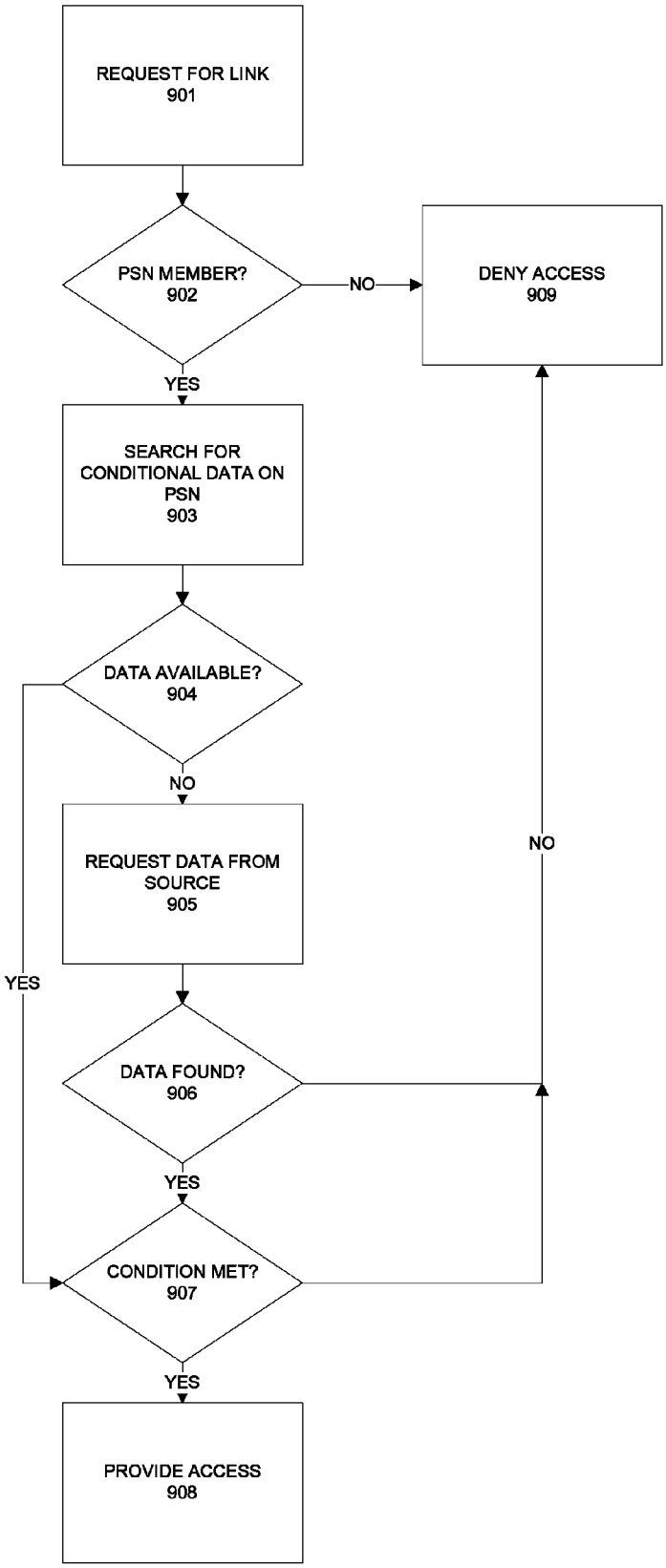
FIG. 9 is a flow diagram illustrating the use of conditionals for access in an embodiment of the system.

FIG. 9 is a flow diagram illustrating the use of conditionals for access in an embodiment of the system. At step 901 a request for access is presented. At decision block 902 it is determined if the visitor is a member of the private social network (PSN). If not, access is denied at step 909. If the visitor is a network member, the system searches for the requested conditional data on the private social network at step 903. This data could include historical behaviour patterns, geo-location information, accomplishments, characteristics, and other data that may have been defined as a condition of access. At decision block 904 it is determined if the conditional data is available on the PSN. If not, the system proceeds to step 905 and requests data from the needed source.

The needed source may be a networked device such as a Fitbit, or some other device that can provide the required conditional data that is being sought. At decision block 906 it is determined if the requested data has been found. If not, the system denies access at step 909.

If the data is available at steps 904 or 906, the system checks to see if the conditions have been met at decision block 907. If so, the system provides access at step 908. If not, the system denies access at step 909.

The conditional data may be based on historical geo-location data. The system could track the locations that a user has been as well as the length of time that the user has been in one or more particular locations. For example, there may be a requirement for access to a certain location that a soldier has been in Iraq for a certain amount of time, as evidenced by geo-location data obtained from the user's mobile device.

The conditions requested at step 903 could be tied to other tasks and accomplishments. Consider a job that requires certain achievements or accomplishments before access to a particular building. For example, military training, lab training, or other training that can be presumed or confirmed by physical presence at a particular location. Such a condition must be met before allowing access to a facility, lab, range, or the like. The physical presence condition may be a supplemental check of credentials, or it may be an automated way to control access until a user has satisfied the location conditions of the facility.

Example Computer System

Figure 6:
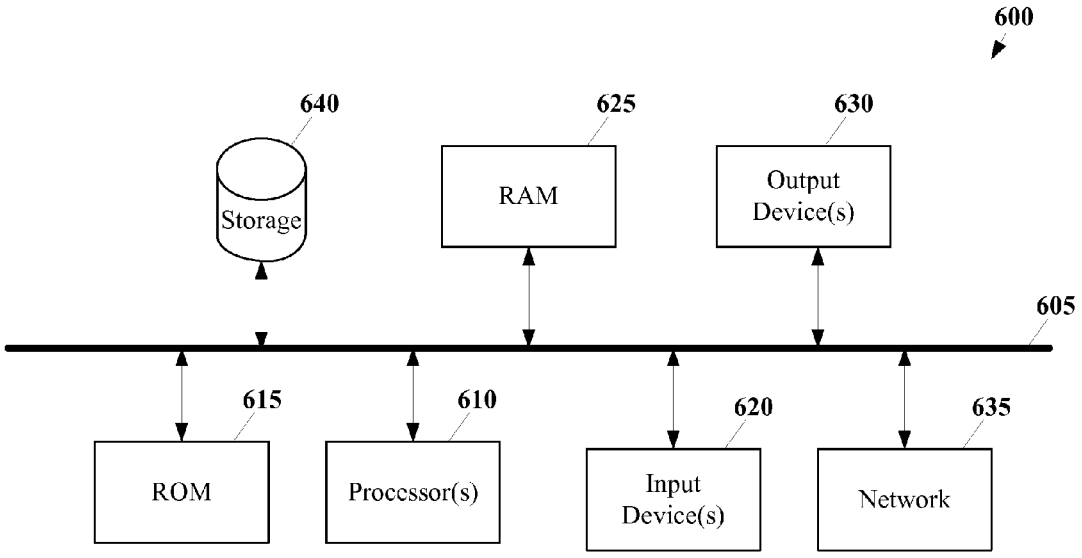
FIG. 6 illustrates an exemplary computer system 600 that may implement the access controller and/or the access control device.

FIG. 6 illustrates an exemplary computer system 600 that may implement the access controller and/or the access control device. The computer system includes various types of computer readable media and interfaces. The system includes a bus 605, processors 610, read only memory (ROM) 615, input device(s) 620, random access memory 625), output device(s) 630, a network component 635, and a permanent storage device 640.

The bus 605 the communicatively connects the internal devices and/or components of the computer system. For instance, the bus 605 communicatively connects the processor(s) 610 with the ROM 615, the RAM 625, and the permanent storage 640. The processor(s) 610 retrieve instructions from the memory units to execute processes of the invention.

The ROM 615 stores static instructions needed by the processor(s) 610 and other components of the computer system. The ROM may store the instructions necessary for the processor to execute the web server, web application, or other web services. The permanent storage 640 is a non-volatile memory that stores instructions and data when the computer system 600 is on or off. The permanent storage 640 is a read/write memory device, such as a hard disk or a flash drive. Storage media may be any available media that can be accessed by a computer. By way of example, the ROM could also be EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), and floppy disk where disks usually reproduce data magnetically, while discs reproduce data optically with lasers. Combinations of the above should also be included within the scope of computer-readable media.

The RAM 125 is a volatile read/write memory. The RAM 625 stores instructions needed by the processor(s) 60 at runtime. The bus 605 also connects input and output devices 620 and 630. The input devices enable the user to communicate information and select commands to the computer system. The input devices 620 may be a keyboard or a pointing device such as a mouse. The input devices 620 may also be a touch screen display capable of receiving touch interactions. The output device(s) 630 display images generated by the computer system. The output devices may include printers or display devices such as monitors.

The bus 605 also couples the computer system to a network 635. The computer system may be part of a local area network (LAN), a wide area network (WAN), the Internet, or an Intranet by using a network interface. The web service may be provided to the user through a web client, which receives information transmitted on the network 635 by the computer system 100.

It is understood that the specific order or hierarchy of steps in the processes disclosed is an illustration of exemplary approaches. Based upon design preferences, it is understood that the specific order or hierarchy of steps in the processes may be rearranged. Further, some steps may be combined or omitted. The accompanying method claims present elements of the various steps in a sample order, and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Combinations such as "at least one of A, B, or C," "at least one of A, B, and C," and "A, B, C, or any combination thereof" include any combination of A, B, and/or C, and may include multiples of A, multiples of B, or multiples of C. Specifically, combinations such as "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for" or, in the case of a method claim, the element is recited using the phrase "step for."

What is claimed is:

1. A method of providing access to a premises comprising: creating a credential to be used to unlock an access control device; identifying a device to be used to present the credential to the access control device; defining a dynamic link to provide the credential to the device; enabling the dynamic link by activating the link so that it is a valid link; presenting the credential to the access control device and to the identified device via the dynamic link; unlocking the access control device when the credential is presented by the identified device.

2. The method of claim 1 wherein the dynamic link is associated with parameters.

3. The method of claim 2 wherein the dynamic link is only enabled when the parameters have been met.

4. The method of claim 3 wherein the parameters include a time range during which the dynamic link may be enabled.

5. The method of claim 4 wherein the parameters include a physical location of the identified device when attempting to enable the dynamic link.

6. The method of claim 5 wherein the parameters include the use of a required wireless network when attempting to enable the dynamic link.

7. The method of claim 6 wherein the credential is a QR code.

8. The method of claim 6 wherein the credential is a bar code.

9. The method of claim 6 wherein the credential is a numeric code.

10. The method of claim 1 wherein the credential is provided to the access control device via the display of the identified device.

11. The method of claim 1 further including a challenge and response that is required before enabling the dynamic link.

12. The method of claim 1 wherein the dynamic link is to data stored in a private social network.

13. The method of claim 1 wherein the credential includes a conditional requirement.

14. The method of claim 13 wherein the conditional requirement comprises a trackable activity on the device.

15. The method of claim 14 wherein the trackable activity comprises the presence of the device at a geo-location for a specified amount of time.

16. The method of claim 14 wherein the trackable activity comprises physical activity data transmitted to the device.

* * * * *